United States Patent [19]

McElroy

[11] 3,937,504

[45] Feb. 10, 1976

[54] PUSH AND PULL DOOR LATCH

[76] Inventor: Richard Lee McElroy, 6205 Ave. Juan Diaz, Riverside, Calif.

[22] Filed: Oct. 3, 1974

[21] Appl. No.: 511,506

[52] U.S. Cl. ..... 292/164; 292/58; 292/172; 292/174; 292/336.3; 292/337

[51] Int. Cl.[2] ..... E05C 1/14

[58] Field of Search ..... 70/449, 461; 292/35, 39, 292/41, 58, 92, 164, 169, 169.19, 170, 172, 174, DIG. 37

[56] References Cited

UNITED STATES PATENTS

| | | | |
|---|---|---|---|
| 200,318 | 2/1878 | Ludlow | 70/146 |
| 1,211,437 | 1/1917 | Gruber | 292/172 |
| 1,461,756 | 7/1923 | Croning | 70/452 |
| 1,589,957 | 6/1926 | Handell | 292/4 |
| 1,720,640 | 7/1929 | Wread | 292/337 |
| 2,036,154 | 3/1936 | Littledale | 292/170 |
| 2,431,105 | 11/1947 | Brinson | 292/172 |
| 3,385,622 | 5/1968 | Winger | 292/170 |
| 3,495,862 | 2/1970 | McClintock | 292/173 |

*Primary Examiner*—Albert G. Craig, Jr.

[57] ABSTRACT

The main housing is an exact size for insertion in the conventional door, is adjustable for door thickness and allows conventional hole cutting and preparation. This housing is cylindrical, and has two sides with working parts built in one side, each side having an external or internal threading to be screwed together. Only one screw is used in installation to connect the two inside and outside sliding recessed plates together.

The latch is retracted by means of a wheel and rod following a cam track, aided by a spring positioned in the latch housing. The track is V-shaped and in the latch housing wall, the wheel and rod traveling down one side thereof after a pull is enacted, or the other side thereof after a push is enacted. The wheel is connected to the latch bolt by the rod.

From the opposite end of the latch the latch bolt is inserted into the hollow pinion housed in the main housing to react to the push and pull.

The latch bolt is projected by springs built in the external threading side of the main housing, one spring being attached to the supporting brace and pinion, the other spring being attached to the standing structure and pinion.

The entire Push and Pull Door Latch is locked in place when the face plate is inserted and screwed.

5 Claims, 5 Drawing Figures

Fig 1
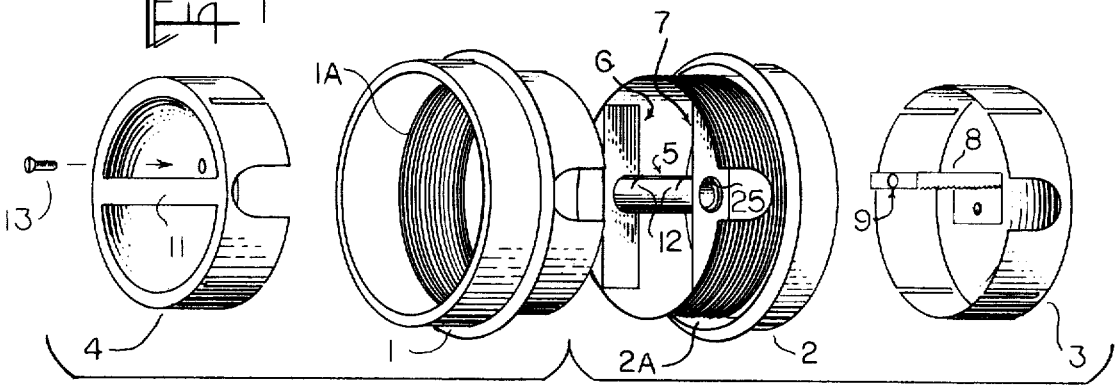
Fig 2
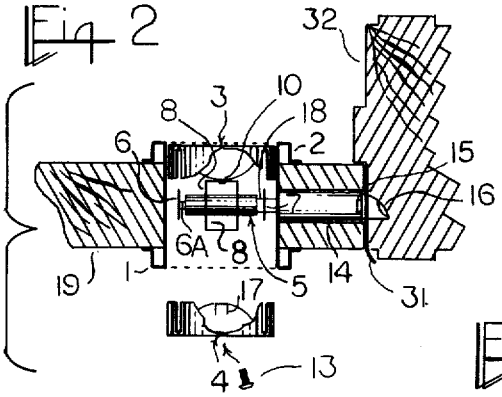
Fig 3
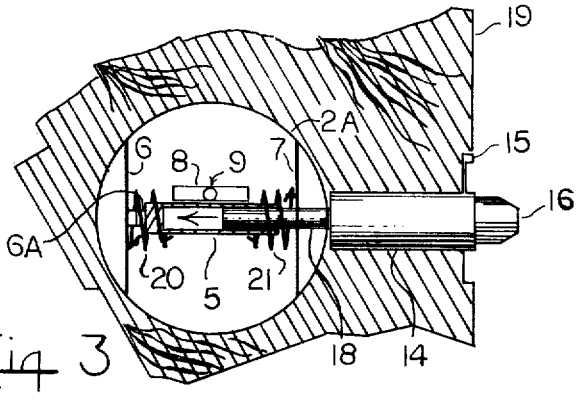
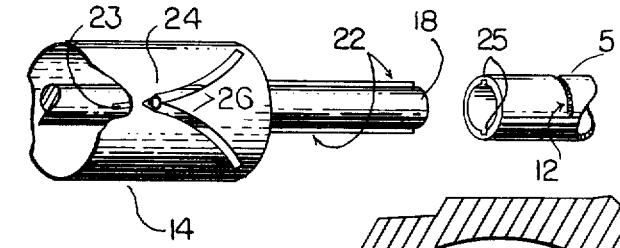
Fig 5
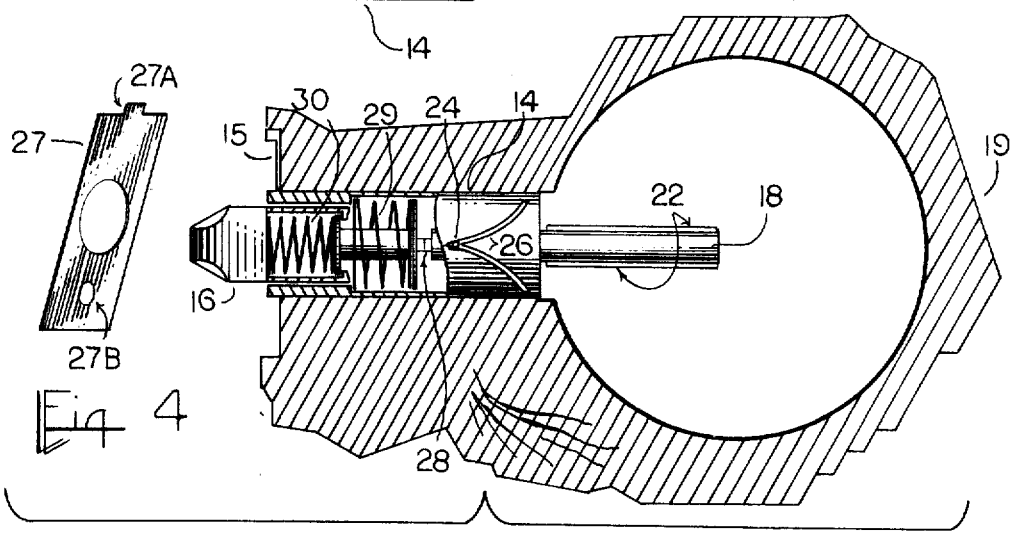
Fig 4

PUSH AND PULL DOOR LATCH

BRIEF SUMMARY

The principal object of the invention is to provide a handsome door set with a push and pull sequence eliminating the knob as a protruding structure from the door and promoting an easier way to operate a latch. With little exertion, a push or pull from any side opening the door in one finger movement even to allow one with full hands to open a door with an elbow. This invention has a minimum number of parts and can be easily assembled.

In carrying out the invention at least one sliding plate with a recess in it's outer face having a handle means disposed across said recess, each sliding plate, being separately constructed members, sliding thereof, having a peripheral wall around the perimeter of each said sliding plate extending in the direction of its insertion into the main housing. If two said sliding plates, they being inserted from opposite sides, thereby the two being transversely opposed from one another, one or two said sliding plates acting as a plunger, each said sliding plates being directly transversely connected to racks, and sliding together with said racks thereof, said racks being parallel and doubly transversely connected at both ends thereby, appearing in the form of a square or a rectangular shape.

The latch bolt and the hollow pinion are in a direct connection, from the opposite end of the latch of the latch bolt into the open end of the said pinion, the pinion is hollow and acts as a sleeve to the latch bolt in a fit which will allow it to slide in or out with the turning of the pinion. To allow both the turning and the transverse, sliding in and out, a key and a keyway association between the latch bolt and said pinion is incorporated into their connection. When said pinion is turning, the latch bolt will slide into the said pinion through means of the cam of the latch housing, thereby retracting and projecting the latch bolt.

The said pinion is supported by the supporting brace through means of a turret, the said turret being attached to the closed or walled end of the said pinion, the said brace is in turn attached in a vertical or upright position in the external threaded side of the main housing.

The cam of the latch housing is a part of the latch housing and has a two sided V shape track, having a full circumference in order to be connected and become part of the latch housing, the latch housing being stationary and not moving in any direction with the latch bolt rod and wheel. One important factor in the construction of the cam of the latch housing is that it be constructed of plastic material and thereby connected to the latch housing to become one, said cam shown as 14 only in FIG. 5, by means of the said cam, as a separate plastic member of the latch housing slipping over the said latch housing perimeter tightly, because the said cam must be a secure part of the latch housing in order to absorb the turning and transverse action of the said latch bolt, wheel and rod.

BRIEF DESCRIPTION OF THE SEVERAL VIEWS

FIG. 1 shows an exploded view of the embodiment of the main housing and the inside and outside sliding recessed plates.

FIG. 2 shows the complex in a top view bracketed with the door, catch and door frame included.

FIG. 3 shows a sectional veiw, viewed from front looking into the external threaded side of the main housing showing only the circumference of the external threads of that part.

FIG. 4 shows a sectional view of the latch housing and cam including the latch bolt, and face plate.

FIG. 5 shows a perspective view of the cam of the latch housing shown here as one member showing also the keyway of the hollowed pinion and the latch bolt as the key thereof.

DETAILED DESCRIPTION

Referring to the drawing and in particular to FIGS. 1, 2 and 3, the main housing is made up of two sides, the external threaded side 2, screws together with the internal threaded side 1, the external threading being 2A, the internal threading being 1A, the external threaded side 2 harbors a hollow pinion 5, the supporting brace 6, and the standing structure 7, the said brace 6, supports the hollowed pinion by means of the turret 6A, allowing the said hollowed pinion 5, to turn right or left in acting as a pinion with the racks 8. In the form as shown here the outside sliding recessed plate 3, harbors the said racks 8, in a connection not detachable from the outside of that said sliding plate. The said outside sliding plate 3, slides into the external threaded side of the main housing 2, while the said racks 8, teeth mesh with the engraved gears 12, of the hollow pinion 5, also in the form as shown here. The inside sliding recessed plate 4, slides in from the opposite side into the internal threaded side 1, of the main housing both said sliding plates 3 and 4, being oppositely faced and thereby connected by a screw 13, to the said racks 8, through the hole 9, in the racks 8, placed in the center of its said transverse connection screwing and attaching the racks 8, of the said outside sliding plate 3, to the said inside sliding plate 4, of the opposite side thereof. The said racks 8, being two parallel sided racks, spaced apart, and double transversely connected at both consecutive ends showing from above in the form of a rectangular, or a square shape depending on the needed length of the racks 8, pertaining to the thickness of the door 19. In the particular form shown and discussed here the said racks 8, act as a structural connection between the said sliding plates 4, and 3.

With reference in particular to FIGS. 1, 2, 3, and 5, the hollow pinion 5, turns as both the said sliding plates 3 and 4, slide inward and outward in the push and pull sequence, the said pinion 5, being hollow, one end open, one end closed thereof. From the open end, the said pinion 5, and its hollow circumference is a running fit to the external perimeter of the latch bolt 18, the said pinion 5, shown here having a keyway or groove here called a keyway 25, running parallel to the hollowed area of the said pinion 5. The latch bolt 18, shown here being the stud, having one or more small parallel sided pieces running along the latch bolt 18, surface and protruding therefrom, here known as a key 22. The said latch bolt 18, and the said pinion 5, are in a direct connection from the opposite end of the latch 16, of the latch bolt 18, into the open end of the hollowed area of the said pinion 5. The latch bolt 18, because of this association, can transversely slide in and out of the said pinion 5, retracting and projecting the latch 16, while turning with the said pinion 5.

The racks 8, teeth, mesh with the engraved gears 12, of the hollowed pinion 5, enabling the left spring 20 to return both said sliding plates 3, and 4, back to their original positions, after a push from the said outside sliding plate 3. The right spring 21, will same as above return the hollowed pinion back to the original position, bringing both said sliding plates 3, and 4, back to their original positions, after a push from the said inside sliding plate 4. In the process the latch 16, has both retracted and then projected under the power of said spring 20, or 21, depending on a push or pull.

with reference to FIGS. 1, 2, 3, and 5, the hollowed pinion 5, and the latch bolt 18, begins to transversely slide into the said painion 5, hollowed area more deeply, enacting the wheel 24, and rod 23, into following the V shaped track 26, as the latch bolt 18, is merging into the said hollowed pinion 5, the latch 16, is retracting, into the latch housing and cam 14, better seen in FIG. 4. As shown in FIG. 4, a spring 29, of the latch housing helps in pushing the wheel 24, and rod 23, up one of the sides of the V shape track 26, depending on a push or pull, at the same time urging the latch bolt 18, into the hollowed pinion 5, as it is turning. The cam of the latch housing shown in FIG. 5, as 14, is a separate part of the latch housing 14, and has a full circumference, same as the latch housing, in order to be connected thereof, becoming a permanent part of the latch housing. The cam of the latch housing shown in FIG. 5 as 14, is stationary and does not move in any direction with the latch bolt 18, wheel 24 and rod 23. It is an important factor that the cam is inexpensive in construction, to achieve this desire, the cam is to be constructed of plastic material. The said cam is connected to the latch housing, by slipping over the said latch housing perimeter tightly. The said cam must be a secure part of the latch housing, in order to absorb the turning, and transversal sliding action of the latch bolt 18, wheel 24 and rod 23.

With reference to FIG. 1, the handle means 11, disposed over the recess area of each of the one or more sliding recessed plates here shown as 3, and 4, is to be used by a finger in the pulling, and or thumb in the pushing, of the said sliding plates 3 and 4. Each said sliding plate 3 and 4, have a peripheral wall extending in the direction of its insertion. This peripheral wall has cuts in it for the supporting brace 6, and the standing structure 7, to slide into during the push and pull sequence, the cuts existing at the top and bottom areas of the said standing structure 7, and supporting brace 6. This giving strength to each said sliding plates 3, and 4, plus giving protection to the racks 8, in a forceable unappropriate turning or an over forceful pushing or pulling, of each said sliding plate 3 and 4. The molded or so reinforced hole 17, is for the screw 13, to meet the racks 8, firmly for a strong connection. The standing structure 7, is shown in FIG. 1 having a hole allowing the latch bolt 18, to pass through to allow its insertion into the hollowed pinion 5.

As introduced earlier in the Detailed Descriptions, the hollowed pinion 5, is supported by the supporting brace 6, through means of a turret, 6A, which is attached to the closed end or walled end of the said pinion 5, the said brace 6, is attached in an upright or vertical position in the external threading side 2, of the main housing.

As shown in FIG. 4, the V shape track 26, in being a V shape, allows the wheel 24, and rod 23, to react to a push or pull, as the latch bolt 18, turns, in doing so another turret 28, of the latch housing, allows it to do so, but not beyond the point where interference with the function of the cam spring 29, would result.

When closing the door 19, after this Push and Pull Door Latch has been enacted the latch 16, when scraped upon the catch 31, the said latch 16, is forced to retract into the latch housing and cam 14, then through power of a spring 30, shown in FIG. 4, the latch 16, is projected out again to hold the door 19, in the closed position to the door frame 32.

In reference to FIG. 4, the face plate 27, is fastened first to the latch housing and cam 14, by means of an insertion stem 27A, positioned on the face plate 27, to be inserted into the receiver and casing 15, following arrow, this so called casing 15, is attached to the latch housing and cam 14, to allow a one screw attachment through the hole 27 B, to complete this end of installation, and to hold the said latch housing secure in the use of this Push and Pull Door Latch.

I claim:

1. In a push and pull door latch, the combination of; a main housing, two sliding plates each with a recess in its outer face having a handle means disposed across said recess, each sliding plate being mounted within said main housing and being a separately constructed member having a peripheral wall extending in the direction of its insertion into the main housing, each being inserted from opposite sides, thereby the two being transversely opposed from one another, said sliding plates each acting as a plunger, a latch bolt operating gear rack disposed between said sliding plates, each said sliding plate being directly transversely connected to opposite ends of said rack and slidable together with said rack.

2. In a latch, the combination of a latch bolt housing, a latch bolt and a hollow pinion open at one end, the end of the latch bolt opposite the latch carrying end extending into the open end of the said pinion, the hollow pinion acting as a sleeve in a running fit to the latch bolt, the said latch bolt and pinion having a key and keyway association in their said connection providing means for said latch bolt to transversely slide in or out of said pinion while turning with said pinion, the latch bolt housing and latch bolt including cooperative cam means whereby turning of the pinion and thus the latch bolt results in retracting and projecting the latch bolt.

3. A combination as defined in claim 2, wherein said hollow pinion is closed at its other end and is supported by a supporting brace through means of a turret, being attached to the closed end of the said pinion.

4. A combination as defined in claim 2, wherein said cam means of the latch housing is part of the latch housing, having a two sided V-shape track.

5. A combination as defined in claim 2, wherein said cam means of the latch housing according to the invention, is constructed of plastic material.

* * * * *